US011952856B2

(12) United States Patent
Katanguri et al.

(10) Patent No.: US 11,952,856 B2
(45) Date of Patent: Apr. 9, 2024

(54) ELECTRIC BLOWOUT PREVENTER BONNET USING LINEAR ACTUATED ROLLER SCREWS

(71) Applicant: Schlumberger Technology Corporation, Sugar Land, TX (US)

(72) Inventors: Suman Katanguri, Houston, TX (US); Todor K. Sheiretov, Houston, TX (US); Bruce Boulanger, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/805,146

(22) Filed: Jun. 2, 2022

(65) Prior Publication Data

US 2022/0389784 A1 Dec. 8, 2022

Related U.S. Application Data

(60) Provisional application No. 63/363,727, filed on Apr. 28, 2022, provisional application No. 63/196,919, filed on Jun. 4, 2021.

(51) Int. Cl.
*E21B 33/06* (2006.01)
*E21B 47/00* (2012.01)

(52) U.S. Cl.
CPC ..... *E21B 33/061* (2013.01); *E21B 47/00* (2013.01)

(58) Field of Classification Search
CPC .. E21B 33/0355; E21B 33/062; E21B 33/063; E21B 33/064; F16K 3/025
See application file for complete search history.

(56) References Cited

U.S. PATENT DOCUMENTS 5,505,426 A * 4/1996 Whitby ..... E21B 33/063 251/1.3
7,231,842 B2 * 6/2007 Biester ..... F16H 25/20 74/89.45
9,863,206 B2 1/2018 Biester
10,767,437 B2 9/2020 Shimonek et al.
(Continued)

FOREIGN PATENT DOCUMENTS

WO WO-2008125136 A1 * 10/2008 ..... F16H 25/2454
WO 2020153961 A1 7/2020
WO 2020169714 A1 8/2020

OTHER PUBLICATIONS

Search Report and Written Opinion of International Patent Application No. PCT/US2022/031964 dated Sep. 19, 2022, 12 pages.

*Primary Examiner* — Kipp C Wallace

(57) ABSTRACT

An electric bonnet includes a housing; a guide piston disposed in the housing; an electric motor having a motor shaft; a rear housing connected to the housing; a gearbox assembly disposed in the rear housing, the gearbox assembly being coupled to the motor shaft of the electric motor; and a roller screw assembly disposed in the rear housing. A first end of the roller screw assembly is connected to the gearbox assembly, and a second end of the roller screw assembly is connected to the guide piston. Rotation of the motor shaft of the electric motor transmits rotary motion to the gearbox assembly, which transforms the rotary motion into linear motion using the roller screw assembly. The linear motion of the roller screw assembly actuates the guide piston.

31 Claims, 8 Drawing Sheets

(56) References Cited

U.S. PATENT DOCUMENTS

| | | | | |
|---|---|---|---|---|
| 11,098,550 | B2 | 8/2021 | Givens et al. | |
| 2004/0031940 | A1* | 2/2004 | Biester | E21B 33/062 251/1.3 |
| 2005/0029476 | A1* | 2/2005 | Biester | F16K 31/046 251/58 |
| 2005/0252316 | A1* | 11/2005 | Biester | F16K 31/047 74/25 |
| 2006/0076526 | A1 | 4/2006 | McWhorter et al. | |
| 2011/0181141 | A1* | 7/2011 | Biester | H02K 49/106 310/154.02 |
| 2012/0241007 | A1* | 9/2012 | Lenz | F16K 31/04 251/213 |
| 2015/0008000 | A1* | 1/2015 | Eriksen | H02K 7/06 74/89.23 |
| 2016/0153580 | A1* | 6/2016 | Lenz | F16K 31/047 251/129.01 |
| 2018/0010411 | A1 | 1/2018 | Kroesen et al. | |
| 2018/0347710 | A1* | 12/2018 | Whitby | E21B 33/062 |
| 2019/0032806 | A1* | 1/2019 | Eriksen | F16K 31/046 |
| 2019/0195020 | A1* | 6/2019 | Kapoor | E21B 3/02 |
| 2020/0284274 | A1* | 9/2020 | van Kuilenburg | E21B 33/062 |
| 2021/0381332 | A1* | 12/2021 | Dhamodaran | E21B 33/062 |
| 2022/0065071 | A1* | 3/2022 | Towers | E21B 34/066 |
| 2022/0145782 | A1* | 5/2022 | Matsuto | H02K 21/16 |

* cited by examiner

ELECTRIC BLOWOUT PREVENTER BONNET USING LINEAR ACTUATED ROLLER SCREWS

CROSS-REFERENCE TO RELATED APPLICATIONS

This application claims priority to and the benefit of U.S. Provisional Application No. 63/196,919, entitled "ELECTRIC BLOWOUT PREVENTER SYSTEM," filed Jun. 4, 2021; and U.S. Provisional Application No. 63/363,727, entitled "ELECTRIC BLOWOUT PREVENTER BONNET USING LINEAR ACTUATED ROLLER SCREWS," filed Apr. 28, 2022. These applications are incorporated by reference in their entireties herein.

BACKGROUND

Current blowout preventer ("BOP") systems utilize either direct hydraulic control or an electro/hydraulic hybrid to power and function the installed BOP. In recent operator driven purchasing specifications, BOP equipment has been required to operate in deeper and more challenging environments while at the same time improving operational availability. These increased requirements have provided situations where a failure of the hydraulic operating system can result in significant and costly downtime. Accordingly, there is a need to electrically control and operate BOPs.

SUMMARY

According to one or more embodiments of the present disclosure, a BOP includes a main body; a bore extending axially through the main body; a ram cavity in communication with the bore, the ram cavity extending laterally on either side of the bore; a pair of opposing ram blocks disposed in the ram cavity; and a pair of electric bonnets secured to the main body, wherein the pair of electric bonnets is correspondingly connected to the pair of the opposing ram blocks, each electric bonnet of the pair of electric bonnets comprising: a housing; a guide piston disposed in the housing, the guide piston comprising: a piston head; and a connecting rod connected to the piston head, wherein the connecting rod is connected to a corresponding ram block of the pair of opposing ram blocks; an electric motor having a motor shaft; a rear housing connected to the housing; a gearbox assembly disposed in the rear housing, the gearbox assembly being coupled to the motor shaft of the electric motor; a roller screw assembly disposed in the rear housing, the roller screw assembly having a first end and a second end, wherein the first end of the roller screw assembly is connected to the gearbox assembly, and wherein the second end of the roller screw assembly is connected to the guide piston, wherein rotation of the motor shaft of the electric motor transmits rotary motion to the gearbox assembly, wherein the gearbox assembly transforms the rotary motion into linear motion using the roller screw assembly, and wherein the linear motion of the roller screw assembly actuates the guide piston, thereby driving the corresponding ram block of the pair of opposing ram blocks into the bore of the BOP via the connecting rod.

According to one or more embodiments of the present disclosure, an electric bonnet includes a housing; a guide piston disposed in the housing; an electric motor having a motor shaft; a rear housing connected to the housing; a gearbox assembly disposed in the rear housing, the gearbox assembly being coupled to the motor shaft of the electric motor; and a roller screw assembly disposed in the rear housing, the roller screw assembly having a first end and a second end, wherein the first end of the roller screw assembly is connected to the gearbox assembly, and wherein the second end of the roller screw assembly is connected to the guide piston, wherein rotation of the motor shaft of the electric motor transmits rotary motion to the gearbox assembly, wherein the gearbox assembly transforms the rotary motion into linear motion using the roller screw assembly, and wherein the linear motion of the roller screw assembly actuates the guide piston.

A method according to one or more embodiments of the present disclosure includes monitoring a well condition of a wellbore; actuating an electric blowout preventer ("BOP") in response to the well condition being indicative of blowout conditions, wherein the electric BOP includes: a main body; a bore extending axially through the main body; a ram cavity in communication with the bore, the ram cavity extending laterally on either side of the bore; a pair of opposing ram blocks disposed in the ram cavity; and a pair of electric bonnets secured to the main body, wherein the pair of electric bonnets is correspondingly connected to the pair of opposing ram blocks, each electric bonnet of the pair of electric bonnets including: a housing; a guide piston disposed in the housing, the guide piston including: a piston head; and a connecting rod connected to the piston head, wherein the connecting rod is connected to a corresponding ram block of the pair of opposing ram blocks; an electric motor having a motor shaft; a rear housing connected to the housing; a gearbox assembly disposed in the rear housing, the gearbox assembly being coupled to the motor shaft of the electric motor; a roller screw assembly disposed in the rear housing, the roller screw assembly having a first end and a second end, wherein the first end of the roller screw assembly is connected to the gearbox assembly, and wherein the second end of the roller screw assembly is connected to the guide piston; and directing the pair of opposing ram blocks toward one another to seal off the bore or shear a tubular string extending through the bore.

According to one or more embodiments of the present disclosure, a system includes: an electric bonnet comprising an electric motor; an electric power source; and a control system, including: a programmable logic controller; and a servo drive, wherein the electric motor is configured to receive electric power from the electric power source through the servo drive, wherein the programmable logic controller is configured to receive the electric power from the electric power source, and wherein the servo drive is configured to receive instructions from the programmable logic controller for controlling the electric motor.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
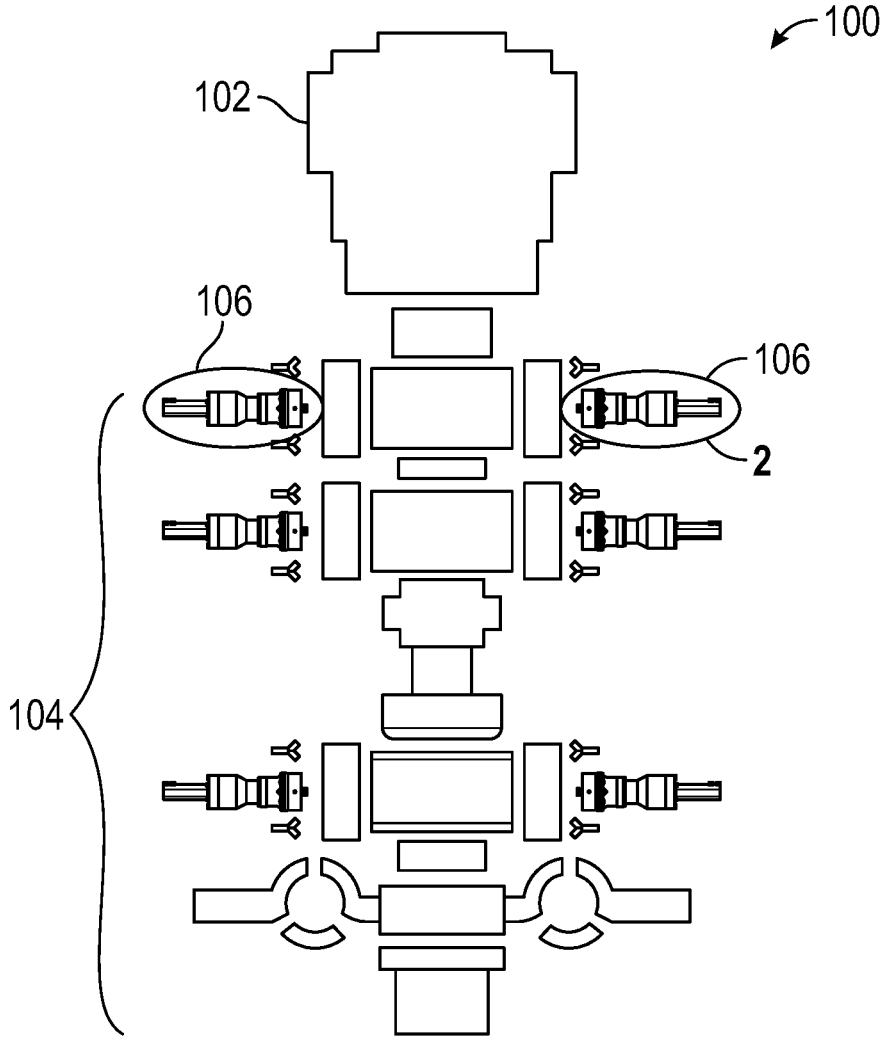
FIG. 1 shows a front view of a BOP assembly including a plurality of electric bonnets, according to one or more embodiments of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Recent developments in electric motor control and control system methodologies have provided the flexibility and feasibility to control and operate BOPs electrically rather than using hydraulics. Accordingly, one or more embodiments of the present disclosure relate to electric BOP systems and methods of using the same, which may be used to seal, control, and monitor hydrocarbon wells. Advantageously, these electric BOP systems may be more reliable and efficient than hydraulic BOP systems, while reducing operating costs, and size and weight for the overall pressure control equipment.

Referring now to FIG. 1, a front view of a BOP assembly 100 is shown, according to one or more embodiments of the present disclosure. As shown, the BOP assembly 100 includes an annular BOP 102 and a plurality of ram-type BOPs 104. According to one or more embodiments of the present disclosure, the ram-type BOP 104 may include a main body and a bore extending axially through the main body. The bore of the ram-type BOP 104 enables passage of fluid or tubular members through the ram-type BOP 104. According to one or more embodiments of the present disclosure, the ram-type BOP 104 may also include a ram cavity in communication with the bore, and the ram cavity may extend laterally on either side of the bore. According to one or more embodiments of the present disclosure, a pair of opposing ram blocks may be disposed in the ram cavity. Different types of ram blocks may be used for multiple applications, such as, pipe, blind, shear and seal, blind shear, or variable bore, according to one or more embodiments of the present disclosure, for example. As further shown in FIG. 1, a pair of electric bonnets 106 is secured to the main body of the ram-type BOP 104, such that the pair of electric bonnets 106 is correspondingly connected to the pair of opposing ram blocks according to one or more embodiments of the present disclosure.

Figure 2:
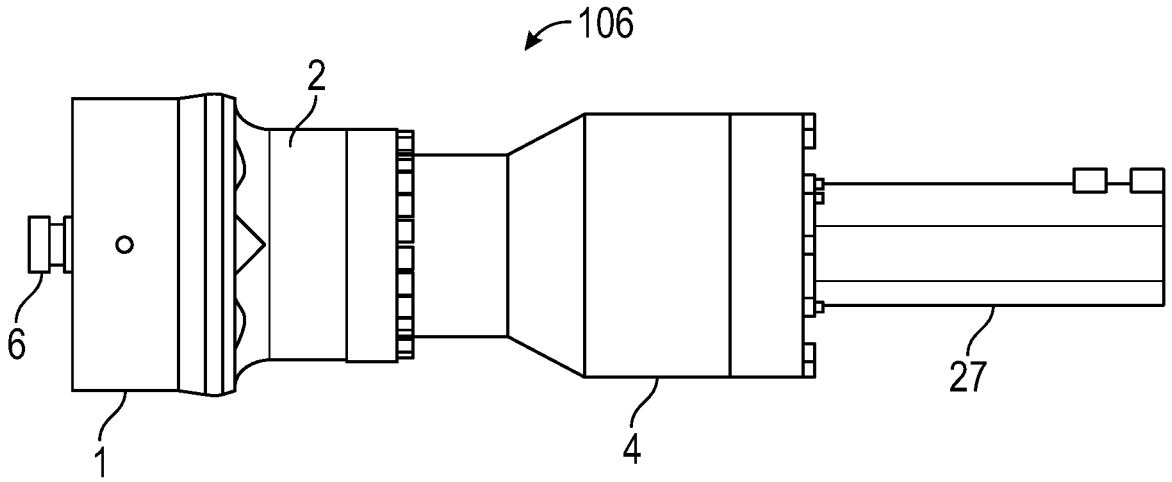
FIG. 2 shows an enlarged isometric view of one of the electric bonnets of FIG. 1, according to one or more embodiments of the present disclosure.

Referring now to FIG. 2, an enlarged isometric view of one of the electric bonnets 106 of FIG. 1 is shown, according to one or more embodiments of the present disclosure. As shown in FIG. 2, and as further described below, the electric bonnet 106 according to one or more embodiments of the present disclosure includes, inter alia, a bonnet flange 1 connected to a housing 2, a rear housing 4 connected to the housing 2, and an electric motor 27. As further shown in FIG. 2, and as further described below, the bonnet flange 1 includes a central aperture that accommodates a connecting rod 6 of a guide piston, according to one or more embodiments of the present disclosure.

Figure 3:
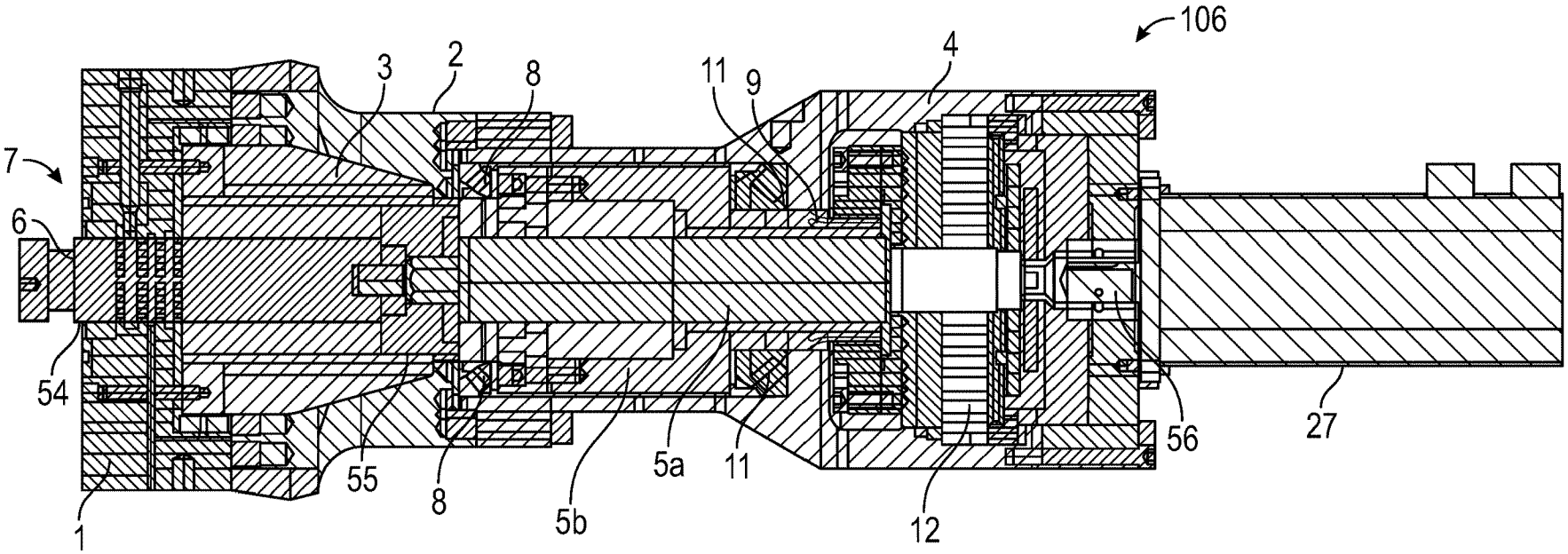
FIG. 3 shows a cross-sectional view of an electric bonnet, according to one or more embodiments of the present disclosure.

Referring now to FIG. 3, a cross-sectional view of an electric bonnet 106 according to one or more embodiments of the present disclosure is shown. As shown in FIG. 3, the cross-sectional view of the electric bonnet 106 shows the bonnet flange 1 connected to the housing 2, the rear housing 4 connected to the housing 2, and the electric motor 27, as previously mentioned in view of FIG. 2. According to one or more embodiments of the present disclosure, the electric bonnet 106 is secured to the main body of the ram-type BOP 104 via the bonnet flange 1 and a plurality of fasteners, for example. Moreover, the cross-sectional view of the electric bonnet 106 shown in FIG. 3 more clearly shows the central aperture 54 of the bonnet flange 1, which accommodates the connecting rod 6 of the guide piston 7, as previously mentioned in view of FIG. 2. Indeed, as shown in FIG. 3, the guide piston 7, which is disposed in the housing 2 of the electric bonnet 106, includes a piston head 55 and the connecting rod 6 connected to the piston head 55. According to one or more embodiments of the present disclosure, the connecting rod 6 is connected to a corresponding ram block of the pair of opposing ram blocks, as previously described. As such, when the guide piston 7 of the electric bonnet 106 is actuated, the corresponding ram block of the opposing ram blocks is driven into the bore of the ram-type BOP 104 via the connecting rod 6, according to one or more embodiments of the present disclosure. When the opposing ram blocks of the pair of opposing ram blocks are directed toward one another in this way, the opposing ram blocks are able to seal off the bore or shear a tubular string extending through the bore during well control operations, for example.

Still referring to FIG. 3, the electric bonnet 106 according to one or more embodiments of the present disclosure also includes a guide sleeve 3 disposed within the housing 2 of the electric bonnet 106. As shown in FIG. 3, for example, the guide sleeve 3 is connected to the bonnet flange 1, and the guide sleeve 3 slidably accommodates the guide piston 7, according to one or more embodiments of the present disclosure. In this way, the guide sleeve 3 supports and ensures proper alignment of the guide piston 7 of the electric bonnet 106 as the guide piston 7 is actuated as previously described, according to one or more embodiments of the present disclosure.

Further, the cross-sectional view shown in FIG. 3 shows a gearbox assembly 12 disposed in the rear housing 4 of the electric bonnet 106. According to one or more embodiments of the present disclosure, the gearbox assembly 12 includes a cycloidal gearbox. As further shown in FIG. 3, the gearbox assembly 12 is coupled to a motor shaft 56 of the electric motor 27, according to one or more embodiments of the present disclosure. With this configuration, rotation of the motor shaft 56 of the electric motor 27 transmits rotary motion to the gearbox assembly 12.

Still referring to FIG. 3, the electric bonnet 106 also includes a roller screw assembly 5 disposed in the rear housing 4, according to one or more embodiments of the present disclosure. As shown in FIG. 3, a first end of the roller screw assembly 5 is connected to the gearbox assembly 12, and a second end of the roller screw assembly 5 is connected to the guide piston 7, according to one or more embodiments of the present disclosure. The first end of the roller screw assembly 5 may be connected to the gearbox assembly 12 via an adapter 9, as shown in FIG. 3 for example, according to one or more embodiments of the present disclosure. The roller screw assembly 5 according to one or more embodiments of the present disclosure may include a roller screw shaft 5*a* and a roller screw nut 5*b* disposed around the roller screw shaft 5*a*. As previously described, rotation of the motor shaft 56 of the electric motor 27 transmits rotary motion to the gearbox assembly 12, which in turn, causes the adapter 9 to rotate. Rotation of the adapter 9 causes the roller screw assembly 5 to move. That is, the roller screw nut 5*b* of the roller screw assembly 5 rotates, and the roller screw shaft 5*a* moves linearly, according to one or more embodiments into present disclosure. In other embodiments of the present disclosure, the roller screw nut 5*b* of the roller screw assembly 5 is fixed, and the roller screw shaft 5*a* of the roller screw assembly 5 moves linearly. During operation, when the roller screw assembly 5 moves, a plurality of front bearings 8 and a plurality of rear bearings 11 also move. According to one or more embodiments of the present disclosure, the plurality of front bearings 8 and the plurality of rear bearings 11 work together, instead of independently, to facilitate movement of the adapter 9 and the roller screw assembly 5. Thereafter, the gearbox assembly 12 transforms the rotary motion into linear motion using the roller screw assembly 5, according to one or more embodiments of the present disclosure. The linear motion of the roller screw assembly 5 actuates the guide piston 7, thereby driving the corresponding ram block of the pair of opposing ram blocks into the bore of the ram-type BOP 104 via the connecting rod 6 of the guide piston 7, according to one or more embodiments of the present disclosure. According to one or more embodiments of the present disclosure, reversing the direction of the electric motor 27 causes the corresponding ram block of the pair of opposing ram blocks to move out of the bore of the ram-type BOP 104 (i.e., go from closed to open) via the connecting rod 6 of the guide piston 7.

Figure 4A:
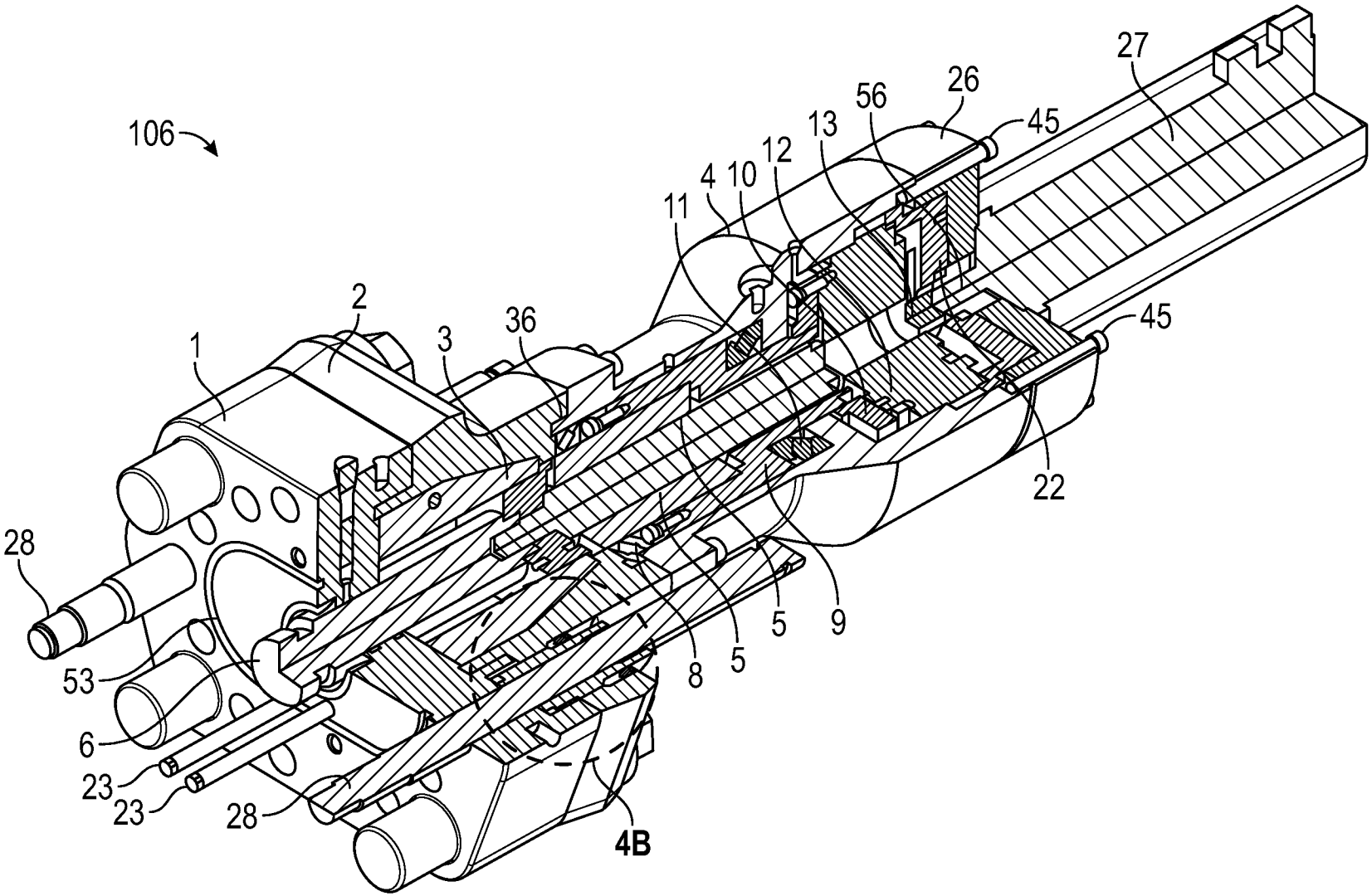
FIG. 4A shows a perspective, partial cross-sectional view of an electric bonnet, according to one or more embodiments of the present disclosure.

Referring now to FIG. 4A, a perspective, partial cross-sectional view of an electric bonnet 106 according to one or more embodiments of the present disclosure is shown. Specifically, FIG. 4A provides a more detailed cross-sectional view of the electric bonnet 106 shown in FIG. 3. For example, as previously described with respect to FIG. 3, FIG. 4A shows the electric bonnet 106 according to one or more embodiments of the present disclosure including, inter alia, the bonnet flange 1, the housing 2, the guide sleeve 3, the rear housing 4, the roller screw assembly 5, the connecting rod 6, the guide piston 7, the plurality of front bearings 8, the adapter 9, the plurality of rear bearings 11, the gearbox assembly 12, and the electric motor 27. As previously described, the rear housing 4 is connected to the housing 2. As shown in FIG. 4A, an O-ring 36 may be disposed between the housing 2 and the rear housing 4 to promote sealing between these components within the electric bonnet 106. As further shown in FIG. 4A, the electric bonnet 106 may also include a flange 26 connected to the rear housing 4 via a plurality of screws 45 or other fasteners to facilitate mounting of the electric motor 27. As previously described, rotation of the motor shaft 56 of the electric motor 27 transmits rotary motion to the gearbox assembly 12, which in turn, causes the adapter 9 to rotate. As shown in FIG. 4A, the electric bonnet 106 may include an input gear 13 connected to the motor shaft 56 to facilitate the transmission of rotary motion from the electric motor 27 to the gearbox assembly 12, according to one or more embodiments of the present disclosure. A middle mounting flange 22 may provide additional support for the input gear 13 and the gearbox assembly 12, as shown in FIG. 4A, for example, according to one or more embodiments of the present disclosure. As further shown in FIG. 4A, the electric bonnet 106 may also include a plate 10 that interfaces between the gearbox assembly 12 and the adapter 9, according to one or more embodiments of the present disclosure. In this way, the plate 10 facilitates the transmission of rotary motion from the gearbox assembly 12 to the adapter 9, according to one or more embodiments of the present disclosure.

Still referring to FIG. 4A, the electric bonnet 106 may also include one or more ram guide pins 23 according to one or more embodiments of the present disclosure. As previously described in view of FIG. 1, a pair of electric bonnets 106 is secured to the main body of the ram-type BOP 104, such that the pair of electric bonnets 106 is correspondingly connected to the pair of opposing ram blocks. According to one or more embodiments of the present disclosure, the one or more guide pins 23 may facilitate the connection of the pair of electric bonnets 106 to the pair of opposing ram blocks during assembly or installation, for example. As also shown in FIG. 4A, the bonnet flange 1 and the housing 2 may accommodate two ram change pistons 28 to facilitate servicing or replacement of the ram associated with the electric bonnet 106.

Figure 4B:
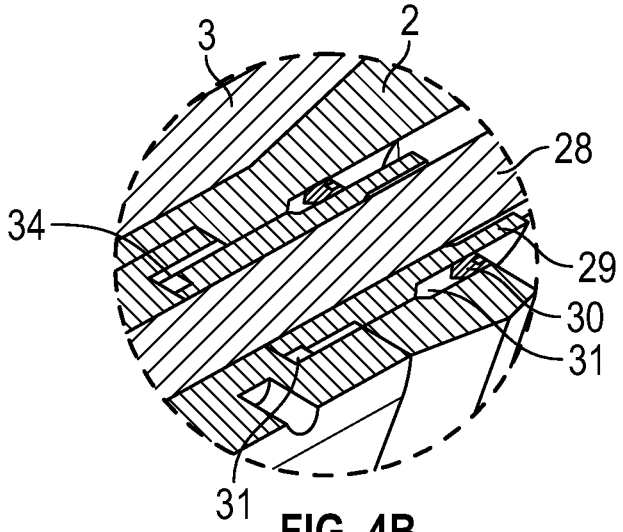
FIG. 4B shows further detail at "4B," as shown in FIG. 4A of the electric bonnet, according to one or more embodiments of the present disclosure.

A portion of FIG. 4A is encircled and labeled with "4B". FIG. 4B shows the further detail of "4B," according to one or more embodiments of the present disclosure. Specifically, FIG. 4B shows that the electric bonnet 106 may also include a ram change piston nut 29, a ram change piston capture nut 30, a plurality of bearings 31, and a ram change piston spacer 34, according to one or more embodiments of the present disclosure. Due to the configuration shown in FIG. 4B, these components support the ram change pistons 28 with respect to the housing 2 of the electric bonnet 106, according to one or more embodiments of the present disclosure.

Figure 4C:
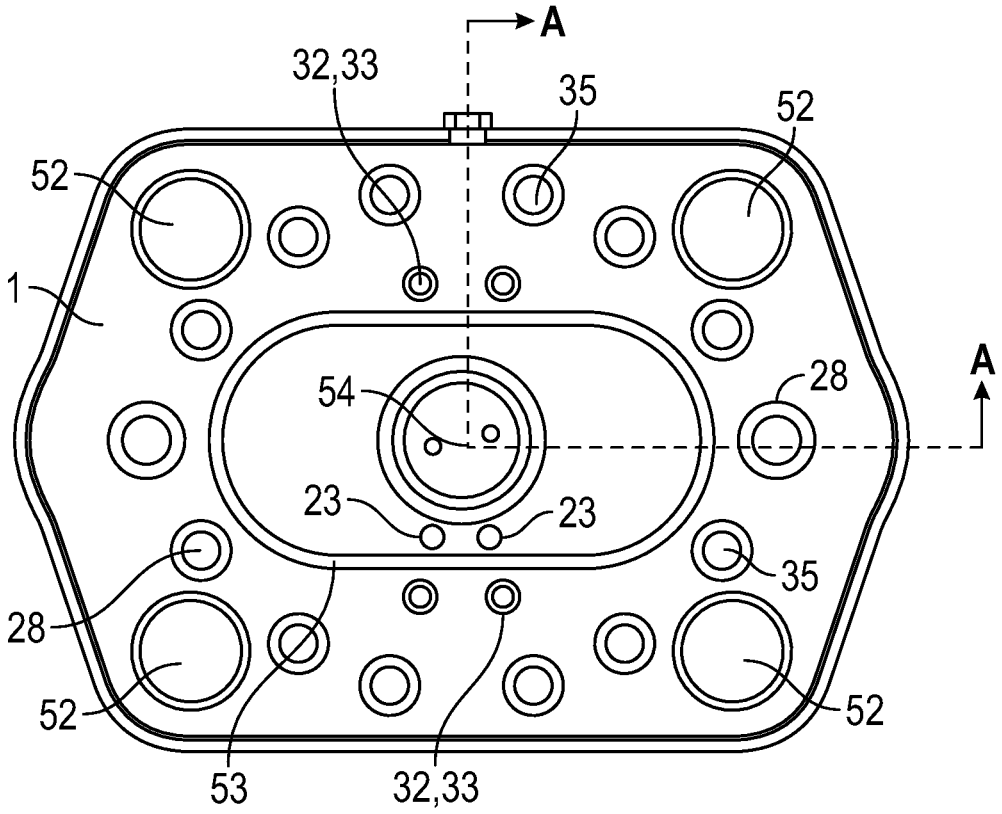
FIG. 4C shows a front view of the bonnet flange, according to one or more embodiments of the present disclosure.

Referring now to FIG. 4C, a front view of the bonnet flange 1 is shown, according to one or more embodiments of the present disclosure. As shown in FIG. 4C, the bonnet flange 1 includes the central aperture 54, which accommodates the connecting rod 6 of the guide piston 7, as previously described. The bonnet flange 1 also includes two holes for accommodating the ram change position screw 28, as previously described. The bonnet flange 1 also includes holes for accommodating the one or more ram guide pins 23, as previously described. As further shown in FIG. 4C, the bonnet flange 1 also includes a plurality of holes arranged in a circular pattern around the face of the bonnet flange 1 for accommodating a plurality of screws 35 or other fasteners to facilitate connecting the bonnet flange 1 to the housing 2, according to one or more embodiments of the present disclosure. As further shown in FIG. 4C, the bonnet flange 1 also includes another set of a plurality of holes for accommodating a plurality of guide sleeve screws 32 and a corresponding plurality of O-rings 33 to facilitate connection of the bonnet flange 1 to the guide sleeve 3, according to one or more embodiments of the present disclosure. As also shown in FIG. 4C, the bonnet flange 1 includes a plurality of holes disposed near the corners of the bonnet flange 1 to accommodate a plurality of bolts 52 to facilitate connection of the bonnet flange 1 to a corresponding ram block, as previously described, according to one or more embodiments of the present disclosure.

Figure 4D:
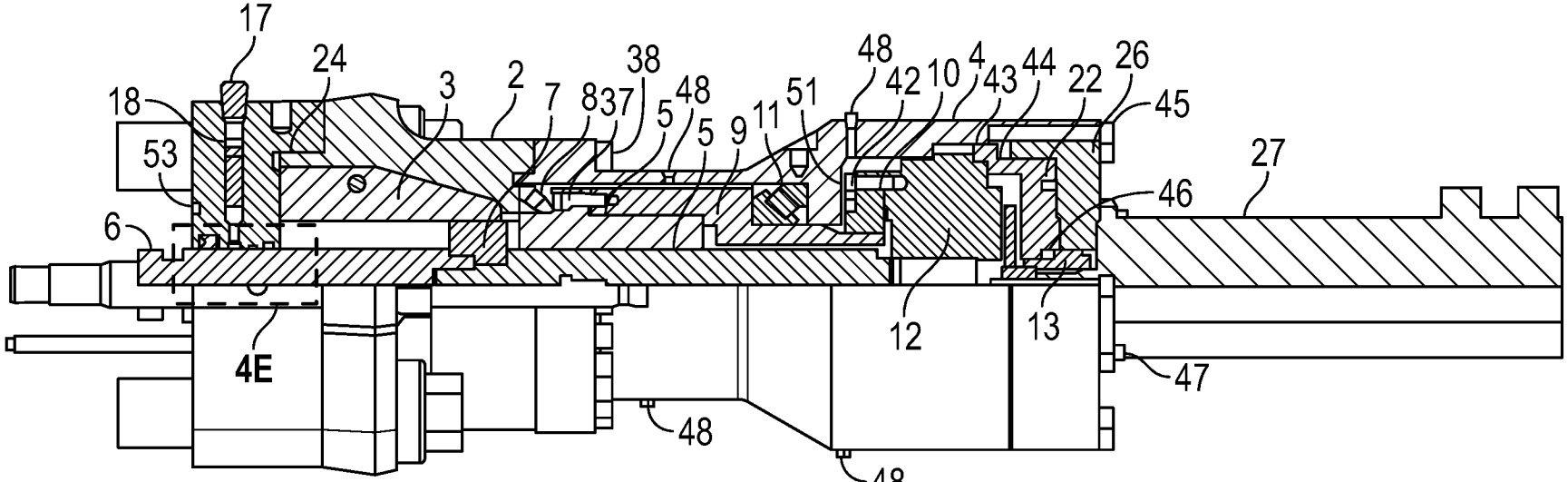
FIG. 4D shows a cross-sectional side view along section "A," as shown in FIG. 4C of the electric bonnet, according to one or more embodiments of the present disclosure.

FIG. 4C also shows section "A". FIG. 4D shows a cross-sectional side view along section "A" of the electric bonnet 106 according to one or more embodiments of the present disclosure. Specifically, FIG. 4D provides additional details of the electric bonnet 106 shown in FIGS. 3 and 4A, as previously described. For example, in addition to the housing 2, guide sleeve 3, rear housing 4, roller screw assembly 5, connecting rod 6, guide piston 7, plurality of front bearings 8, adapter 9, plate 10, plurality of rear bearings 11, gearbox assembly 12, input gear 13, middle mounting flange 22, flange 26, electric motor 27, and plurality of screws 45, as previously described, FIG. 4D also includes an additional set of a plurality of screws 47, or other type of fastener, for connecting the electric motor 27 to the flange 26, according to one or more embodiments of the present disclosure. As also shown in FIG. 4D, the electric bonnet 106 according to one or more embodiments of the present disclosure may also include at least one seal 46 disposed between the middle mounting flange 22 and the input gear 13, for example. As further shown in FIG. 4D, the electric bonnet 106 according to one or more embodiments of the present disclosure may also include a plurality of screws 44, or other type of fasteners, for connecting the middle mounting flange 22 to the gearbox assembly 12. As further shown in FIG. 4D, the electric bonnet 106 according to one or more embodiments of the present disclosure may also include an O-ring seal 43 to promote sealing between the rear housing 4 and the middle mounting flange 22. As further shown in FIG. 4D, the electric bonnet 106 according to one or more embodiments of the present disclosure may also include a plurality of screws 42, or other type of fasteners, for connecting the gearbox assembly 12 to the plate. As further shown in FIG. 4D, the electric bonnet 106 according to one or more embodiments of the present disclosure may also include a plurality of pipe plugs 48 extending through the rear housing 4, for example.

Still referring to FIG. 4D, the electric bonnet 106 according to one or more embodiments of the present disclosure may also include a wave spring 51 disposed in the rear housing 4 proximate the plurality of rear bearings 11 and the adapter 9, for example. According to one or more embodiments of the present disclosure, the wave spring 51 helps properly load up the plurality of bearings and offsets any manufacturing tolerances, for example. As further shown in FIG. 4D, the electric bonnet 106 according to one or more embodiments of the present disclosure may also include a plurality of screws 37, or other type of fasteners, for connecting the adapter 9 to the roller screw assembly 5, and a plurality of screws 38, or other type of fasteners, for connecting the rear housing 4 to the housing 2. As further shown in FIG. 4D, the electric bonnet 106 according to one or more embodiments of the present disclosure may also include an O-ring seal 24 to promote sealing between the bonnet flange 1 and the housing 2, for example. As also shown in FIG. 4D, the electric bonnet 106 according to one or more embodiments of the present disclosure may also include a pipe plug 17 and a screw 16, disposed along a vertical axis of the electric bonnet 106. FIG. 4D also shows a portion of a bonnet seal 53, which may be disposed on the front face of the bonnet flange 1 to provide additional sealing between the interface of the bonnet flange 1 and the corresponding BOP body, according to one or more embodiments of the present disclosure. Additional views of the bonnet seal 53 are shown in FIGS. 4A and 4C, for example.

Figure 4E:
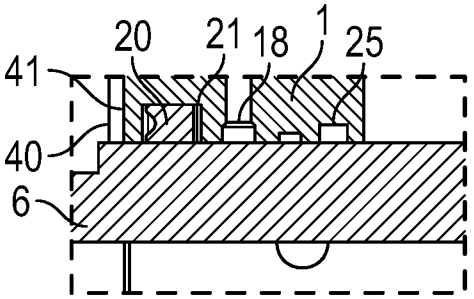
FIG. 4E shows further detail at "4E," as shown in FIG. 4D of the electric bonnet, according to one or more embodiments of the present disclosure.

A portion of FIG. 4D is delineated and labeled with "4E". FIG. 4E shows the further detail of "4E," according to one or more embodiments of the present disclosure. Specifically, FIG. 4E shows additional detail at the interface between the bonnet flange 1 and the connecting rod 6 of the electric bonnet 106, according to one or more embodiments of the present disclosure. For example, FIG. 4E shows that the electric bonnet 106 may include an O-ring 25 to support additional sealing between the bonnet flange 1 and the connecting rod 6, according to one or more embodiments of the present disclosure. As also shown in FIG. 4E, the electric bonnet 106 according to one or more embodiments of the present disclosure may also include an energizing ring 19 and a plastic ring 18, each disposed beneath the screw 16 along the vertical axis of the electric bonnet 106, as previously described. As further shown in FIG. 4E, the interface between the bonnet flange and the connecting rod 6 of the electric bonnet 106 may also include a lip seal retainer 40, a retaining ring 41, a lip seal 20, and a ring gasket 21, according to one or more embodiments of the present disclosure. With this configuration, the connecting rod 6 seals off wellbore fluids from entering the electric bonnet 106, according to one or more embodiments of the present disclosure.

Figure 5:
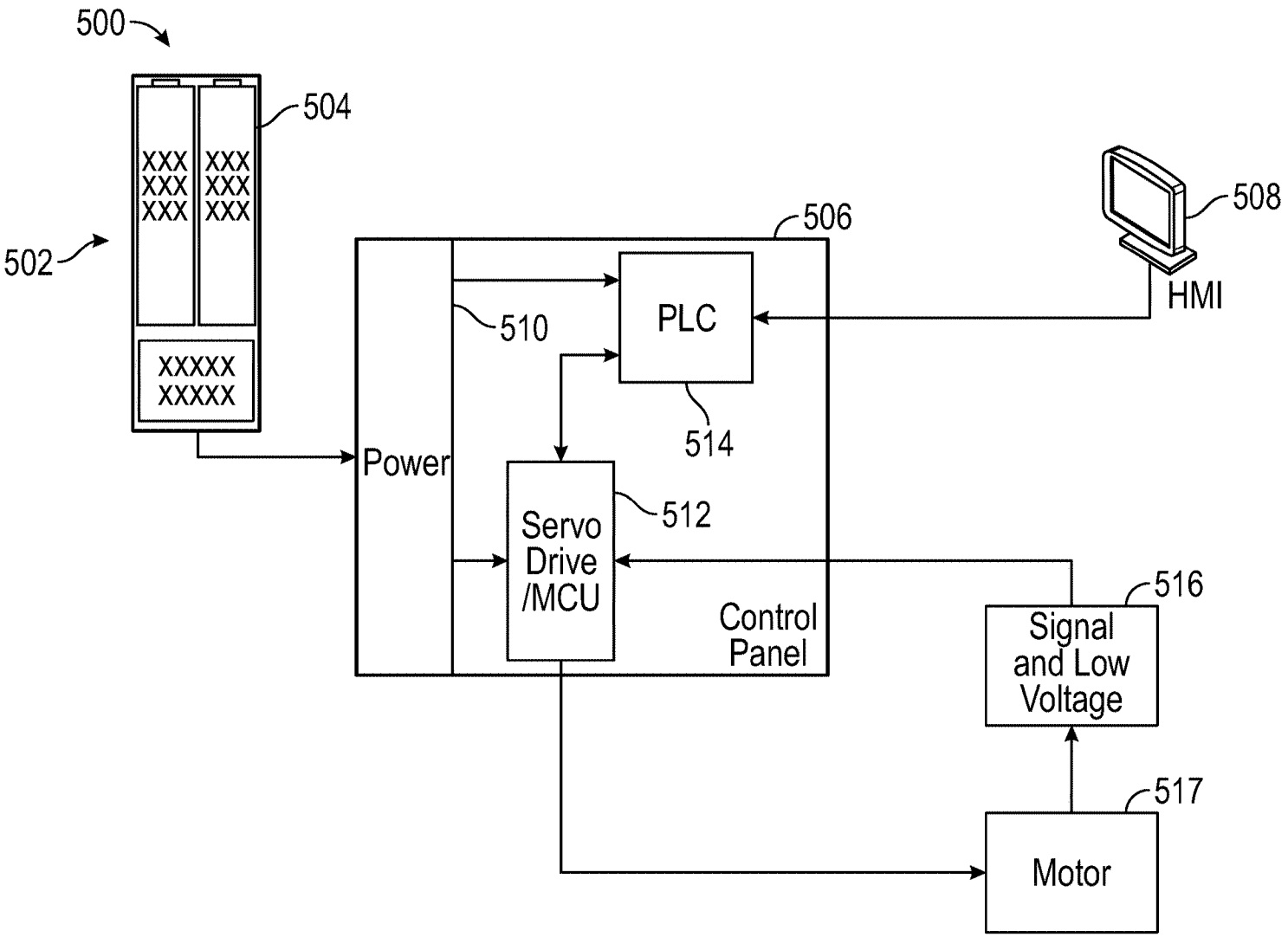
FIG. 5 shows a schematic view of a portion of an electric BOP system, according to one or more embodiments of the present disclosure.

Referring now to FIG. 5, a schematic view of a portion of an electric BOP system 500 according to one or more embodiments of the present disclosure is shown. As shown in FIG. 5, the electric BOP system 500 according to one or more embodiments of the present disclosure includes an electric power source 502, a control system 506 or control panel, a human machine interface ("HMI") 508, a cable 516, and the electric motor 27, as previously described. As shown in FIG. 5, the electric motor 27 is configured to receive electric power from the electric power source 502 for actuation of the electric bonnet 106 according to one or more embodiments of the present disclosure. The electric power source 502 may include a battery system 504, as shown in FIG. 5, or a rig power system (not shown), according to one or more embodiments of the present disclosure. The battery system 504 may have enough stored energy to actuate the electric bonnet 106 in an event of a loss of rig power, for example. As also shown in FIG. 5, the battery system 504 may include a housing configured to hold one or more batteries (two shown) and one or more inverters, according to one or more embodiments of the present disclosure. Alternatively, ultra-capacitors may be used in place of the batteries, according to one or more embodiments of the present disclosure.

Still referring to FIG. 5, the control system 506 according to one or more embodiments of the present disclosure may include a power bus 510, a servo drive 512, and a programmable logic controller ("PLC") 514. According to one or more embodiments of the present disclosure, the electric motor 27 is configured to receive electric power from the electric power source 502 through the power bus 510 and the servo drive 512. Further, the PLC 514 is configured to receive electric power from the electric power source 502 through the power bus 510, according to one or more embodiments of the present disclosure. The servo drive 512 is configured to receive instructions from the PLC 514 for controlling the electric motor 27, and therefore, the electric bonnet 106, according to one or more embodiments of the present disclosure. The electric bonnet 106 according to one or more embodiments of the present disclosure may be controlled electrically and may be further configured such that the guide piston 7 will not back-up if there is a power failure or loss of communication, for example. According to one or more embodiments of the present disclosure, the cable 516 is configured to carry a low voltage signal (e.g., position of the electric motor 27, etc.), back to the servo drive 512.

Still referring to FIG. 5, the HMI 508 of the electric BOP system 500 is communicatively coupled to the PLC 514 of the control system 506, according to one or more embodiments of the present disclosure. The HMI 508 is configured for operator input, via a keyboard or mouse, for example, and the HMI 508 is configured to display, via a screen, for example, information related to the electric BOP system 500, according to one or more embodiments of the present disclosure. Due to the configuration of the PLC 514 as a component of the control system 506, and because the HMI 508 is communicatively coupled to the PLC 514, a PLC algorithm may send commands to the electric bonnet 106 based on well conditions and operator input, for example, according to one or more embodiments of the present disclosure. The control system 506 may control the electric motor 27 and monitor the functioning of the electric bonnet 106, according to one or more embodiments of the present disclosure.

Figure 6A:
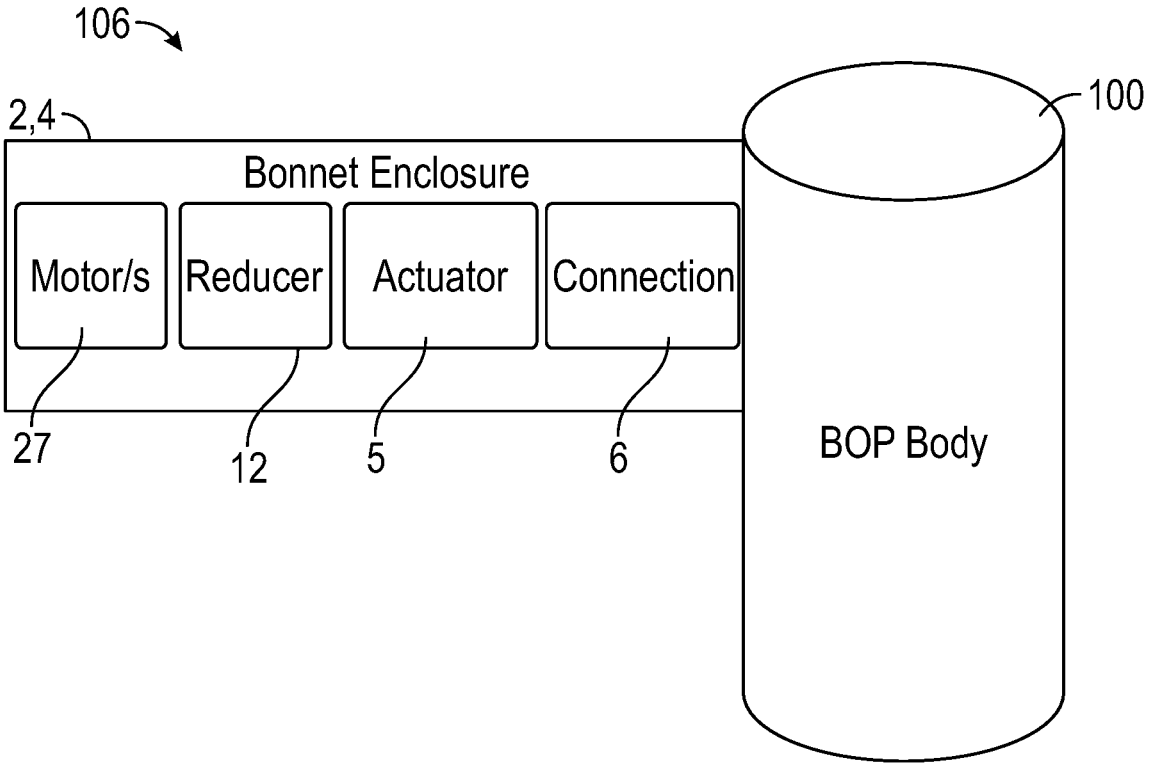
FIG. 6A shows a schematic view of an electric bonnet coupled to a BOP assembly, according to one or more embodiments of the present disclosure.

Referring now to FIG. 6A, a schematic view of an electric bonnet 106 coupled to a BOP assembly 100, such as the BOP assembly 100 of FIG. 1, is shown according to one or more embodiments of the present disclosure. In view of FIG. 6A, the electric bonnet 106 is coupled to the BOP assembly 100 and configured to actuate electrically to close/open the shear and pipe rams. In one or more embodiments of the present disclosure, the electric bonnet 106 may include a planetary roller screw (e.g., roller screw assembly 5) connected to a gear reducer (e.g., gearbox assembly 12), and an electric motor 27 (servo) (FIG. 5) of the electric BOP system. As previously described, the electric bonnet 106 may be controlled electrically and may be further configured such that the piston 7 will not back-up if there is a power failure or loss of communication. As illustrated in FIG. 6A, the electric bonnet 106 may include a bonnet enclosure or housing 2, 4, one or more motors 27, a reducer (e.g., gearbox assembly 12), an actuator (e.g., roller screw assembly 5), and a connection (e.g., connecting rod 6 of a guide piston 7), according to one or more embodiments of the present disclosure.

Figure 6B:
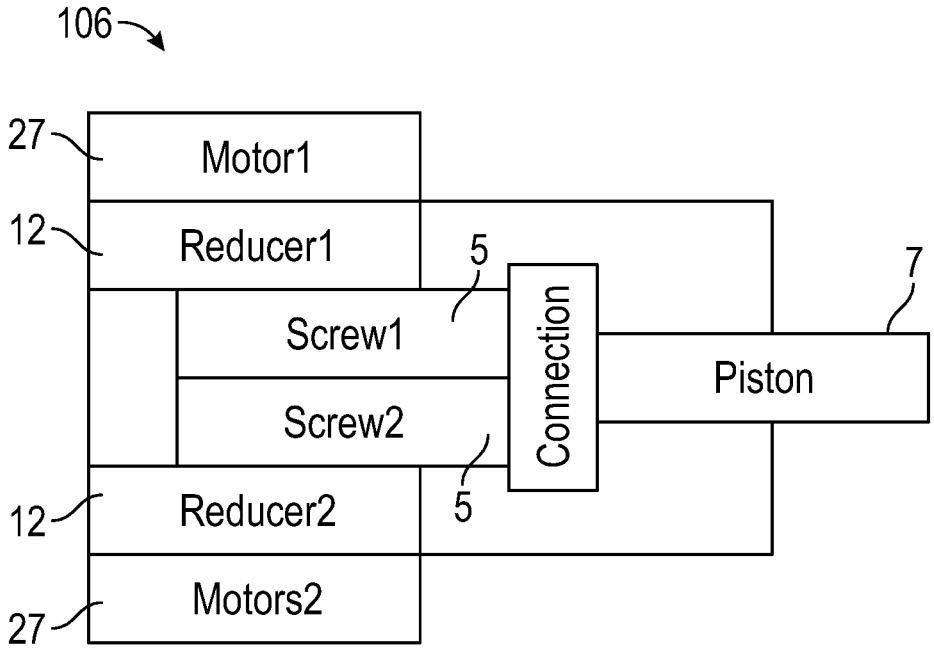
FIG. 6B shows a schematic view of an electric bonnet having redundant components, according to one or more embodiments of the present disclosure.

Referring now to FIG. 6B, a schematic view of an electric bonnet 106 having redundant components is shown, according to one or more embodiments of the present disclosure. For example, the electric bonnet 106 according to one or more embodiments of the present disclosure may have a plurality of electric motors 27, a plurality of gearbox assemblies 12 coupled to the plurality of electric motors 27, a plurality of roller screw assemblies 5 connected to the plurality of gearbox assemblies 12, and a guide piston 7 connected to the plurality of roller screw assemblies 5. In this way, the electric bonnet 106 according to one or more embodiments of the present disclosure includes built-in redundancy of essential components.

In operation, the electric bonnet 106 according to one or more embodiments of the present disclosure may be operated and controlled using one or more electric motors 27 and control systems 506, thus eliminating the need for any hydraulics. The electric bonnet 106 according to one or more embodiments of the present disclosure may operate primarily using rig power, for example, and during a power outage, the electric BOP system 500 may automatically switch to stored energy in the form of batteries or ultra-capacitors.

Figure 7:
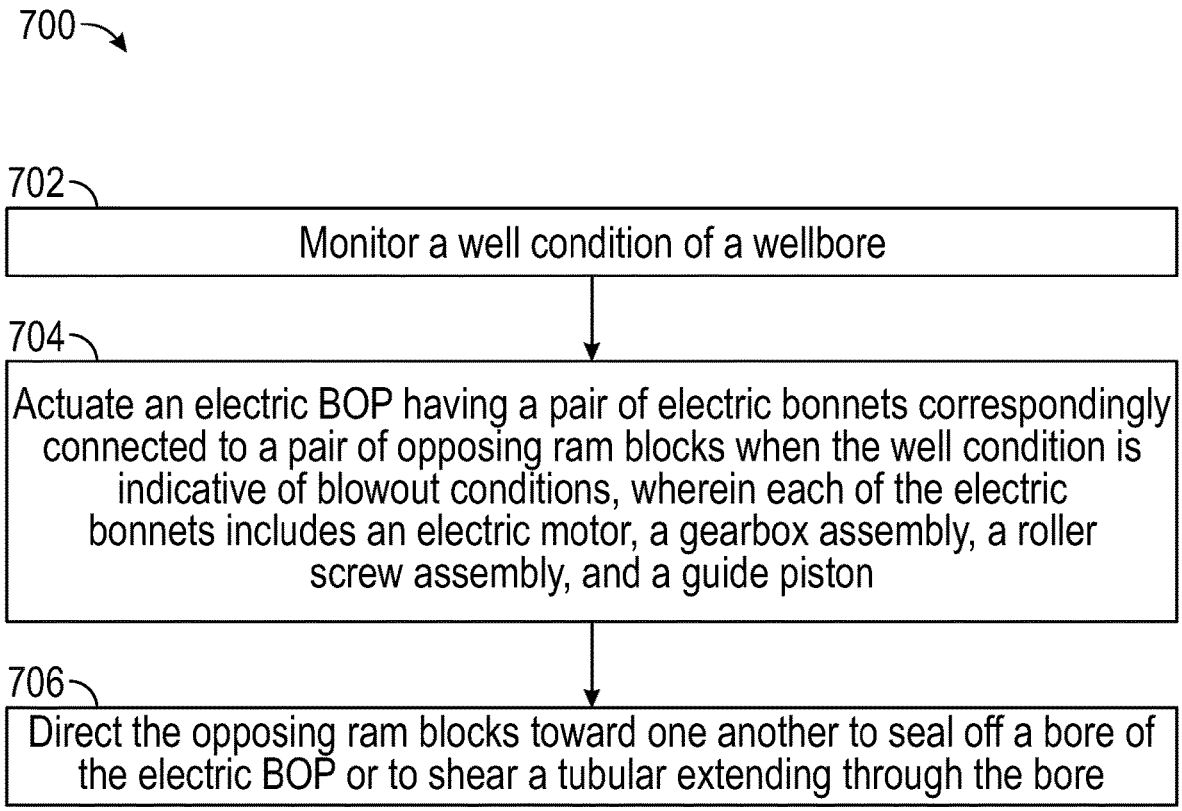
FIG. 7 shows a flow chart of a process for actuating an electric BOP according to one or more embodiments of the present disclosure.

Referring now to FIG. 7, a flow chart of a process 700 for actuating an electric ram-type BOP 104 is shown, according to one or more embodiments of the present disclosure. For example, at step 702, the PLC 514 may be configured to monitor a condition (e.g., a fluid pressure, a fluid temperature, a fluid flow rate, or another suitable operating parameter) of the wellbore. According to one or more embodiments of the present disclosure, a tubular string may be disposed into the wellbore, and thus, may pass through the bore of the ram-type BOP 104. In one or more embodiments of the present disclosure, the bore of the ram-type BOP 104 may be sealed to block a flow of fluid from the wellbore toward the platform of the drilling rig. For example, the wellbore may experience a relatively high pressure (e.g., a kick or blowout conditions), which may ultimately result in inadvertent flow of fluid from the wellbore toward the platform. As such, the PLC 514 may receive feedback from the HMI 508 or from one or more sensors of the electric BOP system 500 (e.g., pressure sensors, temperature sensors, flow sensors, vibration sensors, and/or composition sensors) that may monitor conditions of the wellbore. Thereafter, the PLC 514 may process the feedback received to determine whether to seal the bore of the ram-type BOP 104.

When the PLC 514 determines that the bore of the ram-type BOP 104 should be sealed (e.g., the wellbore is experiencing blowout conditions), the PLC 514 may send one or more signals to the electric motors 27 of the pair of electric bonnets 106, which is correspondingly connected to the pair of opposing ram blocks, to actuate the electric ram-type BOP 104, as shown in step 704. As discussed above, each of the electric bonnets 106 includes the electric motor 27, a gearbox assembly 12, a roller screw assembly 5, and a guide piston 7. At step 706, the opposing ram blocks are moved toward one another to seal off the bore of the electric the ram-type BOP 104 or to shear a tubular extending through the bore of the BOP 104.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A blowout preventer (BOP) comprising:
a main body;
a bore extending axially through the main body;
a ram cavity in communication with the bore, the ram cavity extending laterally on either side of the bore;
a pair of opposing ram blocks disposed in the ram cavity; and
a pair of electric bonnets secured to the main body,
wherein the pair of electric bonnets is correspondingly connected to the pair of the opposing ram blocks, each electric bonnet of the pair of electric bonnets comprising:
a housing;
a guide piston disposed in the housing, the guide piston comprising: a piston head; and a connecting rod connected to the piston head, wherein the connecting rod is connected to a corresponding ram block of the pair of opposing ram blocks,
wherein the housing in which the guide piston is disposed is void of any hydraulic fluid;
an electric motor having a motor shaft;
a rear housing connected to the housing;
a gearbox assembly disposed in the rear housing, the gearbox assembly being coupled to the motor shaft of the electric motor;
a roller screw assembly disposed in the rear housing, the roller screw assembly having a first end and a second end,
wherein the first end of the roller screw assembly is connected to the gearbox assembly, and
wherein the second end of the roller screw assembly is connected to the guide piston,
wherein rotation of the motor shaft of the electric motor transmits rotary motion to the gearbox assembly,
wherein the gearbox assembly transforms the rotary motion into linear motion using the roller screw assembly, and
wherein the linear motion of the roller screw assembly actuates the guide piston, thereby driving the corresponding ram block of the pair of opposing ram blocks into the bore of the BOP via the connecting rod.

2. The BOP of claim 1, each electric bonnet of the pair of electric bonnets further comprising: a bonnet flange connected to the housing,
wherein the electric bonnet is secured to the main body via the bonnet flange and a plurality of fasteners.

3. The BOP of claim 2, wherein the bonnet flange comprises a central aperture that accommodates the connecting rod of the guide piston.

4. The BOP of claim 3, each electric bonnet of the pair of electric bonnets further comprising: a guide sleeve disposed within the housing,
wherein the guide sleeve is connected to the bonnet flange, and
wherein the guide sleeve slidably accommodates the guide piston.

5. The BOP of claim 1, wherein the gearbox assembly comprises a cycloidal gearbox.

6. The BOP of claim 1, wherein the roller screw assembly comprises: a roller screw shaft; and a roller screw nut disposed around the roller screw shaft.

7. The BOP of claim 1, wherein the first end of the roller screw assembly is connected to the gearbox assembly via an adapter.

8. The BOP of claim 7, each electric bonnet of the pair of electric bonnets further comprising: a plurality of bearings that facilitates movement of the adapter and the roller screw assembly.

9. The BOP of claim 1,
wherein the electric motor operates by using a first electric power source during normal operations,
wherein the electric motor operates by using a second electric power source during a power outage,
wherein the first electric power source comprises one of a battery system and a rig power system, and
wherein the second electric power source comprises the other of the battery system and the rig power system.

10. The BOP of claim 1, wherein reversing a direction of the electric motor causes the corresponding ram block of the pair of opposing ram blocks to move out of the bore of the BOP via the connecting rod.

11. A system comprising:
the BOP of claim 9; and
a control system, comprising:
a programmable logic controller; and
a servo drive,
wherein the electric motor is configured to receive electric power from at least one of the first electric power source and the second electric power source through the servo drive,
wherein the programmable logic controller is configured to receive the electric power from at least one of the first electric power source and the second electric power source, and wherein the servo drive is configured to receive instructions from the programmable logic controller for controlling the electric motor.

12. The system of claim 11, further comprising:

a human machine interface communicatively coupled to the programmable logic controller, wherein the human machine interface is configured for operator input, and wherein the human machine interface is configured to display information related to the system.

13. An electric bonnet comprising:

a housing;

a guide piston disposed in the housing, wherein the housing in which the guide piston is disposed is void of any hydraulic fluid;

an electric motor having a motor shaft;

a rear housing connected to the housing;

a gearbox assembly disposed in the rear housing, the gearbox assembly being coupled to the motor shaft of the electric motor; and a roller screw assembly disposed in the rear housing, the roller screw assembly having a first end and a second end, wherein the first end of the roller screw assembly is connected to the gearbox assembly, and wherein the second end of the roller screw assembly is connected to the guide piston, wherein rotation of the motor shaft of the electric motor transmits rotary motion to the gearbox assembly, wherein the gearbox assembly transforms the rotary motion into linear motion using the roller screw assembly, and wherein the linear motion of the roller screw assembly actuates the guide piston.

14. The electric bonnet of claim 13, further comprising: a bonnet flange connected to the housing.

15. The electric bonnet of claim 14, wherein the bonnet flange comprises a central aperture that accommodates the guide piston.

16. The electric bonnet of claim 15, further comprising: a guide sleeve disposed within the housing, wherein the guide sleeve is connected to the bonnet flange, and wherein the guide sleeve slidably accommodates the guide piston.

17. The electric bonnet of claim 13, wherein the gearbox assembly comprises a cycloidal gearbox.

18. The electric bonnet of claim 13, wherein the roller screw assembly comprises: a roller screw shaft; and a roller screw nut disposed around the roller screw shaft.

19. The electric bonnet of claim 13, wherein the first end of the roller screw assembly is connected to the gearbox assembly via an adapter.

20. The electric bonnet of claim 19, further comprising: a plurality of bearings that facilitates movement of the adapter and the roller screw assembly.

21. The electric bonnet of claim 13, wherein the electric motor operates by using a first electric power source during normal operations, wherein the electric motor operates by using a second electric power source during a power outage, wherein the first electric power source comprises one of a battery system and a rig power system, and wherein the second electric power source comprises the other of the battery system and the rig power system.

22. A system comprising:

the electric bonnet of claim 14; and a control system, comprising:

a programmable logic controller; and a servo drive, wherein the electric motor is configured to receive electric power from a first electric power source through the servo drive during normal operations, wherein the electric motor is configured to receive electric power from a second electric power source during a power outage, wherein the programmable logic controller is configured to receive the electric power from at least one of the first electric power source and the second electric power source, and wherein the servo drive is configured to receive instructions from the programmable logic controller for controlling the electric motor.

23. The system of claim 22, wherein the first electric power source comprises one of a battery system and a rig power system, and wherein the second electric power source comprises the other of the battery system and the rig power system.

24. The system of claim 22, further comprising:

a human machine interface communicatively coupled to the programmable logic controller, wherein the human machine interface is configured for operator input, and wherein the human machine interface is configured to display information related to the system.

25. A method, comprising:

monitoring a well condition of a wellbore;

actuating an electric blowout preventer ("BOP") in response to the well condition being indicative of blowout conditions, wherein the electric BOP comprises:

a main body;

a bore extending axially through the main body;

a ram cavity in communication with the bore, the ram cavity extending laterally on either side of the bore;

a pair of opposing ram blocks disposed in the ram cavity; and a pair of electric bonnets secured to the main body, wherein the pair of electric bonnets is correspondingly connected to the pair of opposing ram blocks, each electric bonnet of the pair of electric bonnets comprising:

a housing;

a guide piston disposed in the housing, the guide piston comprising: a piston head; and a connecting rod connected to the piston head, wherein the connecting rod is connected to a corresponding ram block of the pair of opposing ram blocks, wherein the housing in which the guide piston is disposed is void of any hydraulic fluid;

an electric motor having a motor shaft;

a rear housing connected to the housing;

a gearbox assembly disposed in the rear housing, the gearbox assembly being coupled to the motor shaft of the electric motor;

a roller screw assembly disposed in the rear housing, the roller screw assembly having a first end and a second end, wherein the first end of the roller screw assembly is connected to the gearbox assembly, and wherein the second end of the roller screw assembly is connected to the guide piston; and directing the pair of opposing ram blocks toward one another to seal off the bore or shear a tubular string extending through the bore.

26. The method of claim 25, wherein the actuating step further comprises:

rotating the motor shaft of the electric motor;

transmitting rotary motion from the motor shaft to the gearbox assembly;

transforming the rotary motion into linear motion using the roller screw assembly; and actuating the guide piston, thereby driving the corresponding ram block of the opposing ram blocks into the bore of the BOP via the connecting rod.

27. The method of claim 25, wherein the gearbox assembly comprises a cycloidal gearbox.

28. The method of claim 25, wherein the first end of the roller screw assembly is connected to the gearbox assembly via an adapter.

29. The method of claim 25, wherein, during the actuating step, the electric motor operates by using a first electric power source during normal operations, and the electric motor operates by using a second electric power source during a power outage, and wherein the electric motor is configured to receive electric power from at least one of the first electric power source and the second electric power source through a servo drive.

30. The method of claim 29, wherein the first electric power source comprises one of a battery system and a rig power system, and wherein the second electric power source comprises the other of the battery system and the rig power system.

31. The method of claim 29 further comprising receiving instructions by the servo drive from a programmable logic controller for controlling the electric motor.

* * * * *